US011584587B2

(12) United States Patent
McKee et al.

(10) Patent No.: US 11,584,587 B2
(45) Date of Patent: Feb. 21, 2023

(54) DIAPER PAIL WITH REFRIGERATED INTERIOR COMPARTMENT

(71) Applicants: Austin McKee, Greenwood Village, CO (US); Eric M Sia, Ballwin, MO (US)

(72) Inventors: Austin McKee, Greenwood Village, CO (US); Eric M Sia, Ballwin, MO (US)

( * ) Notice: Subject to any disclaimer, the term of this patent is extended or adjusted under 35 U.S.C. 154(b) by 495 days.

(21) Appl. No.: 16/708,973

(22) Filed: Dec. 10, 2019

(65) Prior Publication Data

US 2020/0354145 A1 Nov. 12, 2020

Related U.S. Application Data

(60) Provisional application No. 62/845,055, filed on May 8, 2019.

(51) Int. Cl.
*B65F 1/06* (2006.01)
*B65F 1/16* (2006.01)

(52) U.S. Cl.
CPC ..... *B65F 1/1646* (2013.01); *B65F 1/06* (2013.01); *B65F 1/1615* (2013.01); *B65F 2001/1676* (2013.01); *B65F 2210/116* (2013.01); *B65F 2240/132* (2013.01)

(58) Field of Classification Search
CPC ..... B65F 1/06; B65F 1/1646; B65F 1/1615; B65F 2001/1676; B65F 2210/116; B65F 2240/132
USPC ... 220/256.1, 259.2, 592.02, 592.03, 495.01, 220/495.06, 495.08, 495.11, 908, 908.1, 220/254.1; 62/457.9
See application file for complete search history.

(56) References Cited

U.S. PATENT DOCUMENTS

| | | | | |
|---|---|---|---|---|
| 7,696,711 | B2 * | 4/2010 | Pollack | B65F 1/1607 53/574 |
| 8,317,051 | B2 * | 11/2012 | Jin | B65F 1/1607 220/254.5 |
| 10,710,800 | B2 * | 7/2020 | Wegner | B65F 1/06 |
| 2006/0288728 | A1 | 12/2006 | Brewer | |
| 2007/0125792 | A1 | 6/2007 | Pollack | |
| 2009/0230131 | A1 * | 9/2009 | McDuffie | B65F 1/1607 220/23.91 |
| 2013/0233857 | A1 * | 9/2013 | Yang | B65F 1/04 220/495.08 |
| 2018/0044108 | A1 * | 2/2018 | Ackerman | B65F 1/068 |
| 2019/0218029 | A1 * | 7/2019 | Petz | B65F 1/163 |

FOREIGN PATENT DOCUMENTS

| | | |
|---|---|---|
| WO | WO2015129127 | 9/2015 |
| WO | WO2018029510 | 2/2018 |

* cited by examiner

*Primary Examiner* — John K Fristoe, Jr.
*Assistant Examiner* — Elizabeth J Volz
(74) *Attorney, Agent, or Firm* — Leyendecker & Lemire LLC

(57) ABSTRACT

A diaper pail incorporating a refrigerated compartment is described herein, wherein the interior of the compartment can be cooled to low temperatures, typically less than 32 degrees Fahrenheit, to hinder and/or substantially slow the generation of noxious odors. Additionally, the diaper pail freezer includes a double lid with a bag retaining system to help ensure a good seal is maintained between the lid and the top of the pail to help contain any residual odors within the compartment.

19 Claims, 11 Drawing Sheets

DIAPER PAIL WITH REFRIGERATED INTERIOR COMPARTMENT

RELATED APPLICATIONS

This application claims priority to and incorporates fully by reference U.S. Provisional Patent Application No. 62/845,055 filed on May 8, 2019, which has the same inventors as the present application.

BACKGROUND

Diaper pails are well known and typically comprise trash receptacles with lids that hinder the escape of odors emanating from soiled diapers contained therein. Often by design, plastic trash bags are draped over the top edges of the pail and intervene between the lid and the underlying top surfaces of the top edges acting to prevent or hinder the creation of an effective seal. For instance, if the plastic bag wrinkles or bunches along the top edge interface when a new diaper is tossed into the pail, the lid may no longer be able to make an effective seal and orders may seep out of the pail. Additionally, no matter how good the seal is between the lid and the top of the pail odors are released when the lid is opened as is necessary to add a soiled diaper to the pail.

The strength and pervasiveness of the odors can vary depending on the prevailing temperatures. If the temperature in the room in which the pail resides is warmer then the strength pervasiveness of the odors can be greater; whereas if the room is cooler the odors may be less pronounced. This can be especially bothersome on hot summer days in a room that is not air conditioned.

DETAILED DESCRIPTION

Figure 1:
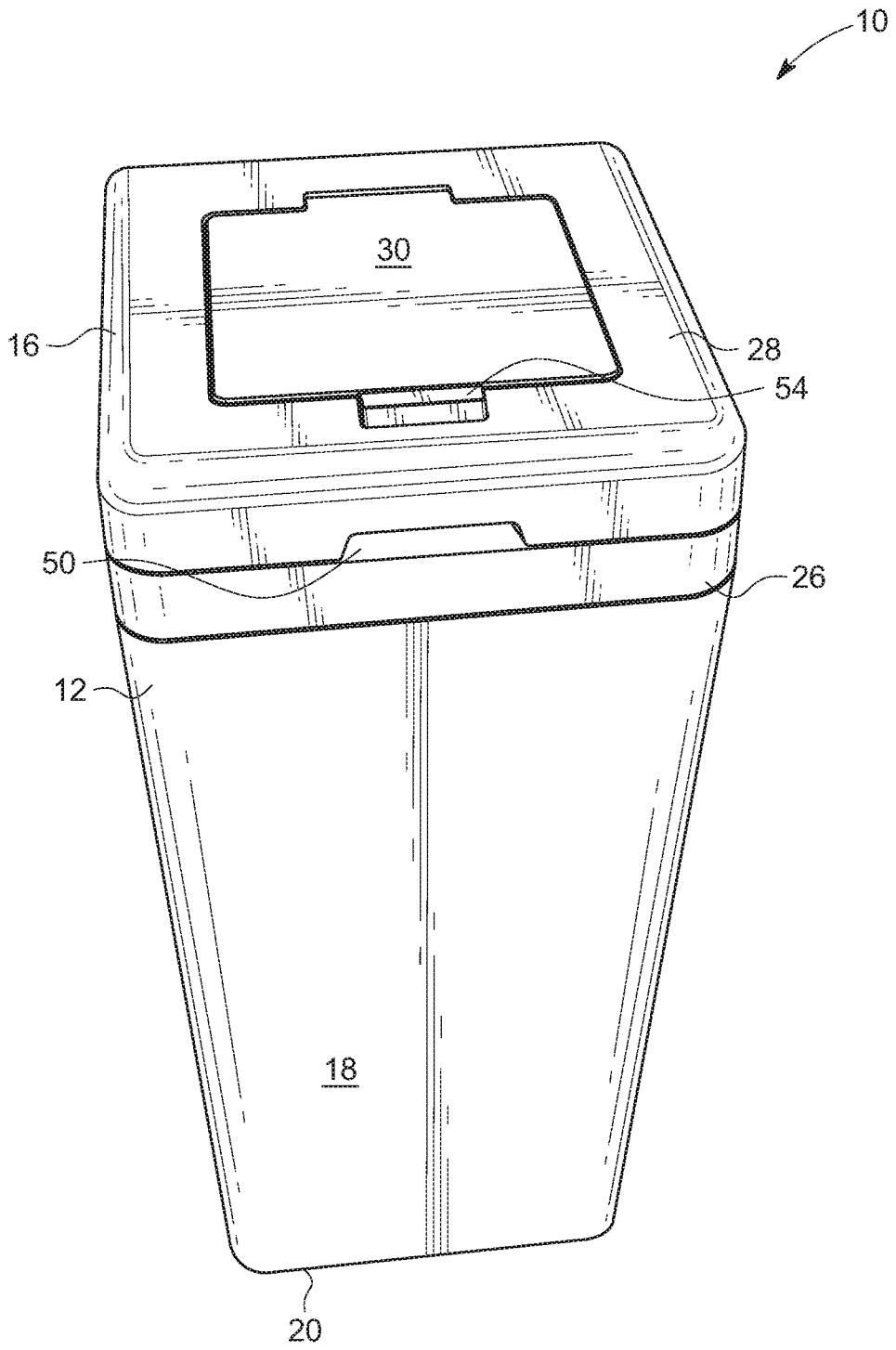
FIG. 1 is a front side perspective of the diaper pail freezer according to an embodiment of the present invention.

A diaper pail incorporating a refrigerated compartment is described herein, wherein the interior of the compartment can be cooled to low temperatures, typically less than zero degrees Celsius, to hinder and/or substantially slow the generation of noxious odors. Additionally, the diaper pail freezer includes a double lid with a bag retaining system to help ensure a good seal is maintained between the lid and the top of the pail to help contain any residual odors within the compartment.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The terms “approximately” and “substantially” as used in this specification and appended claims, refers to plus or minus 10% of the value given.

The terms “about” and “generally” as used in this specification and appended claims, refers to plus or minus 20% of the value given.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Diaper Pail with a Refrigerated Interior Compartment

An embodiment of the diaper pail is illustrated in FIGS. 1-9. Generally, the diaper pail 10 comprises a cuboid body 12 that in part defines an interior compartment 14, a lid assembly 16, and a refrigeration system 17 housed within the body between the outside walls 18 & 20 thereof and the interior walls 22 & 24 of the interior compartment.

Figure 2:
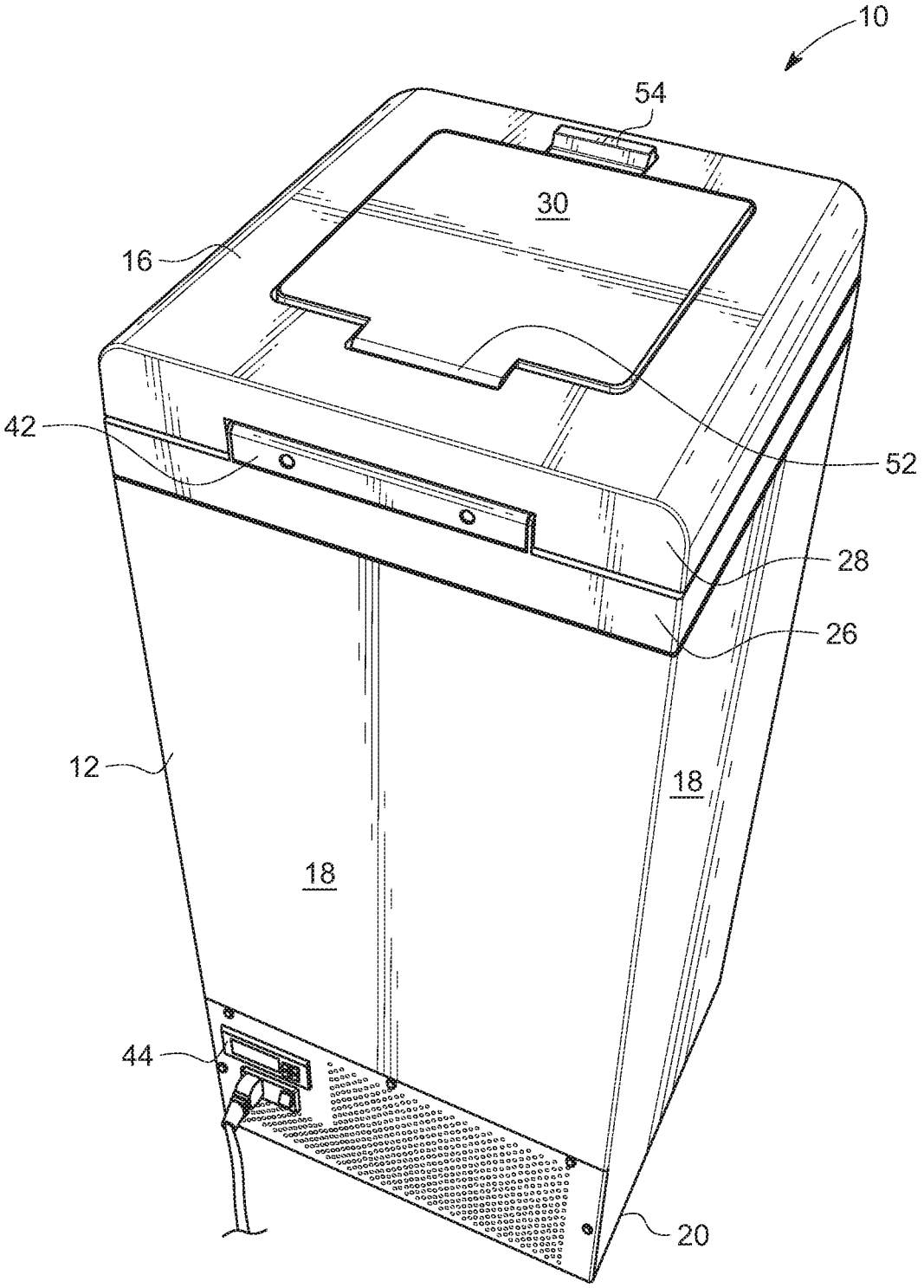
FIG. 2 is a back side perspective of the diaper pail freezer according to the embodiment of the present invention.
Figure 5:
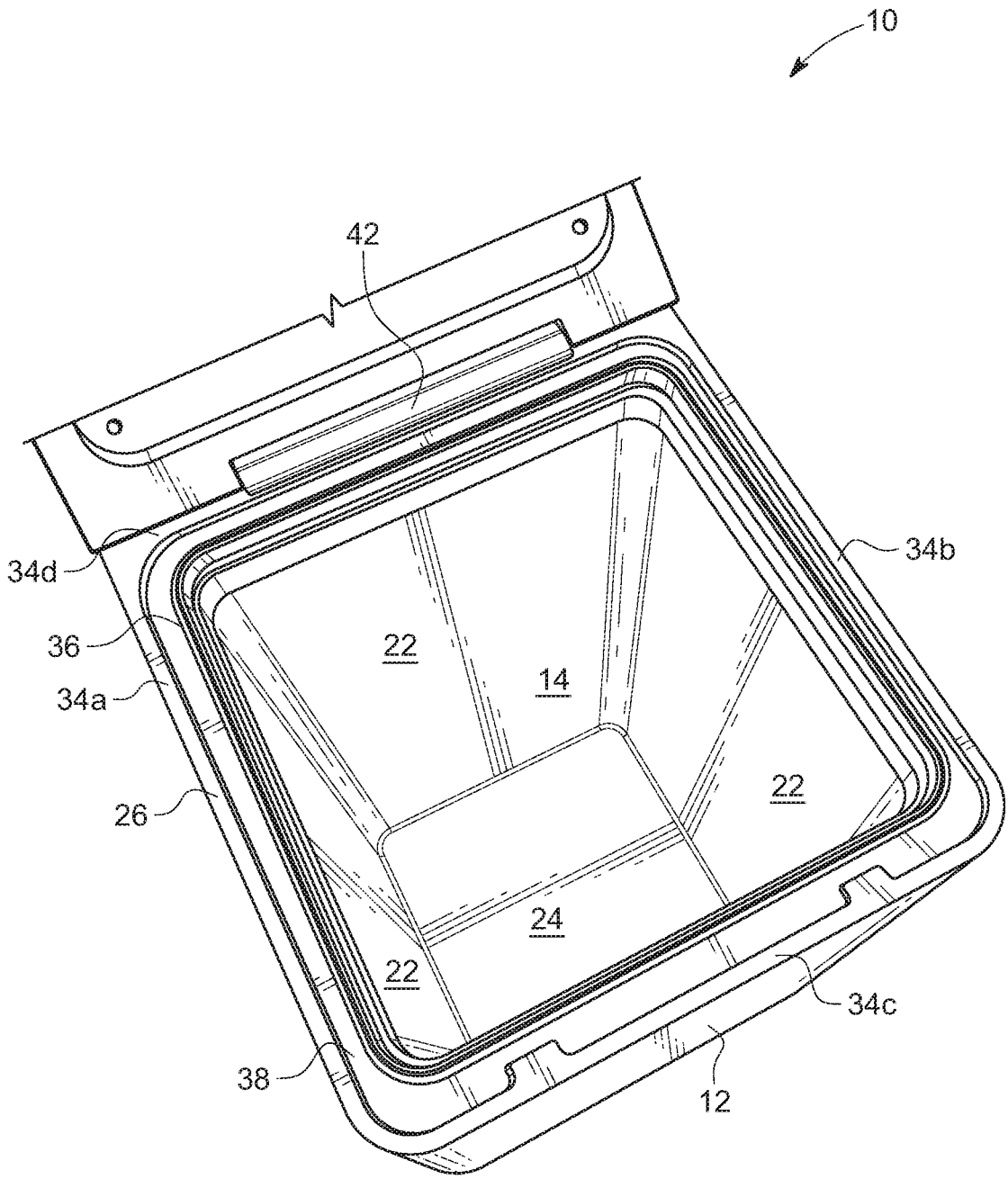
FIG. 5 is a close up top side perspective view of the diaper pail freezer with the outer lid open illustrating the circumscribing ridge and the circumscribing channel located next to the ridge according to the embodiment of the present invention.
Figure 9:
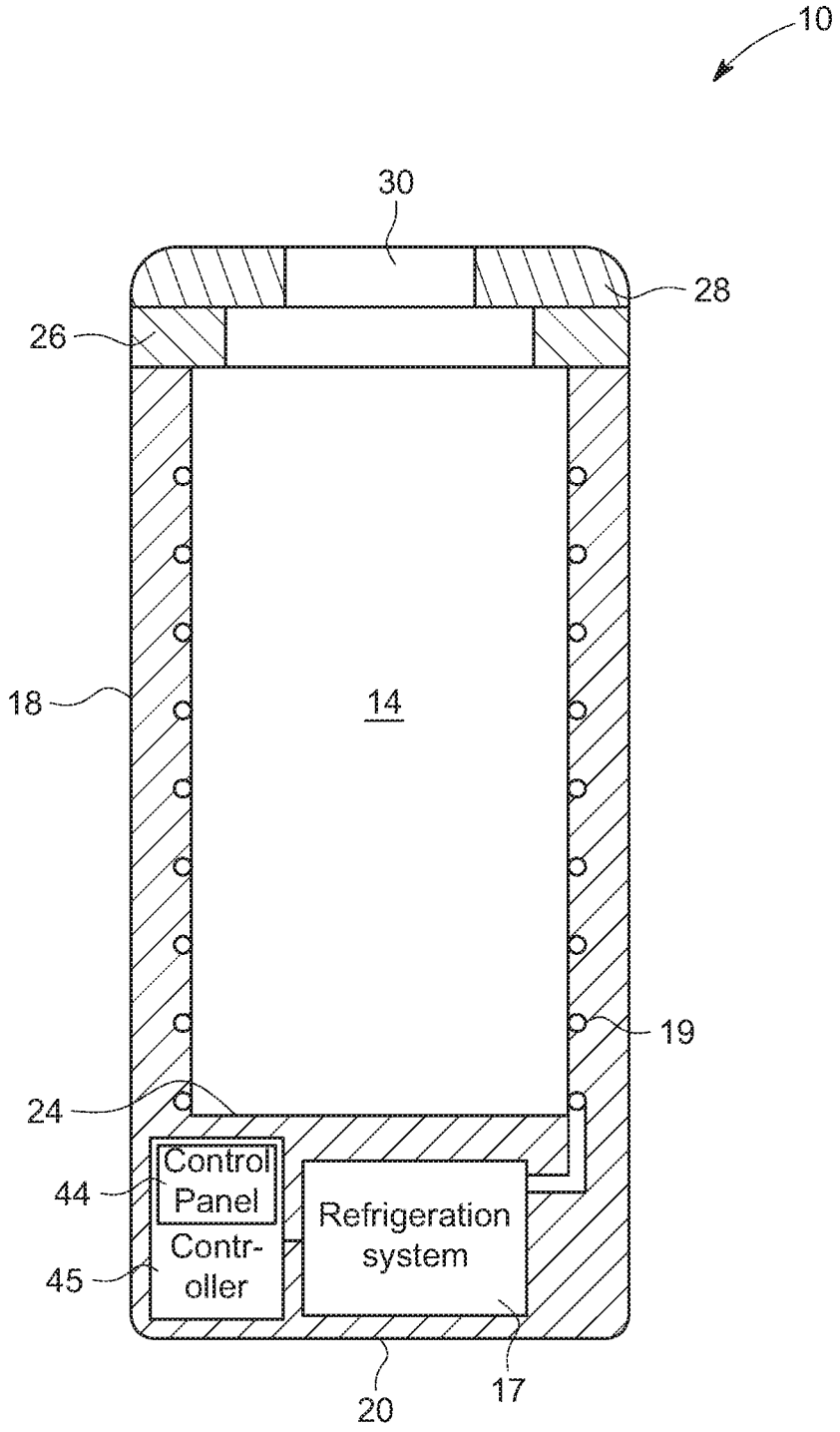
FIG. 9 is a diagrammatic cross sectional view illustrating the general configuration and components of the embodiment of the present invention.

The body 12 is best shown in FIGS. 1, 2 & 5. It comprises four substantially vertical exterior sidewalls 18 and an exterior bottom sidewall 20 forming the body's exterior, and four substantially vertical interior sidewalls 22 and an interior bottom sidewall 24. The interior and exterior sidewalls are spaced from each other and house the refrigeration system 17 as best seen in FIG. 9. The top side of the body is open and the lid assembly 16 is secured thereto. The body 12 can be comprised of any suitable materials but typically the exterior walls are made of a plastic wherein one or more of the interior sidewalls are metal to facilitate heat transfer and the remaining sidewalls can be plastic.

With reference to FIG. 9, a compressor-type refrigeration system 17 is housed within the body. The refrigeration system is typically configured to cool the interior of the interior compartment to a temperature at or 10 degrees Celsius and more preferably below freezing. The system includes a compressor, a consensor, an expansion valve, and an evaporator all coupled into a loop with suitable tubing that circulates a refrigerant that cycles between being a liquid and a gas as it removes heat from the interior compartment. Most of the components are located in the base of the body between the exterior sidewall 20 and the interior bottom sidewall 24. Tubing 19 carrying the super cooled refrigerant is typically routed over and against one or more metal sidewalls of the interior and acts to pull heat from the interior compartment thus cooling it. The refrigeration system and its operation are well known and need not be described in detail herein. Different types of refrigeration systems can be substituted for the compressor-type system including, but not limited to, a system based utilizing thermoelectric modules.

Figure 8:
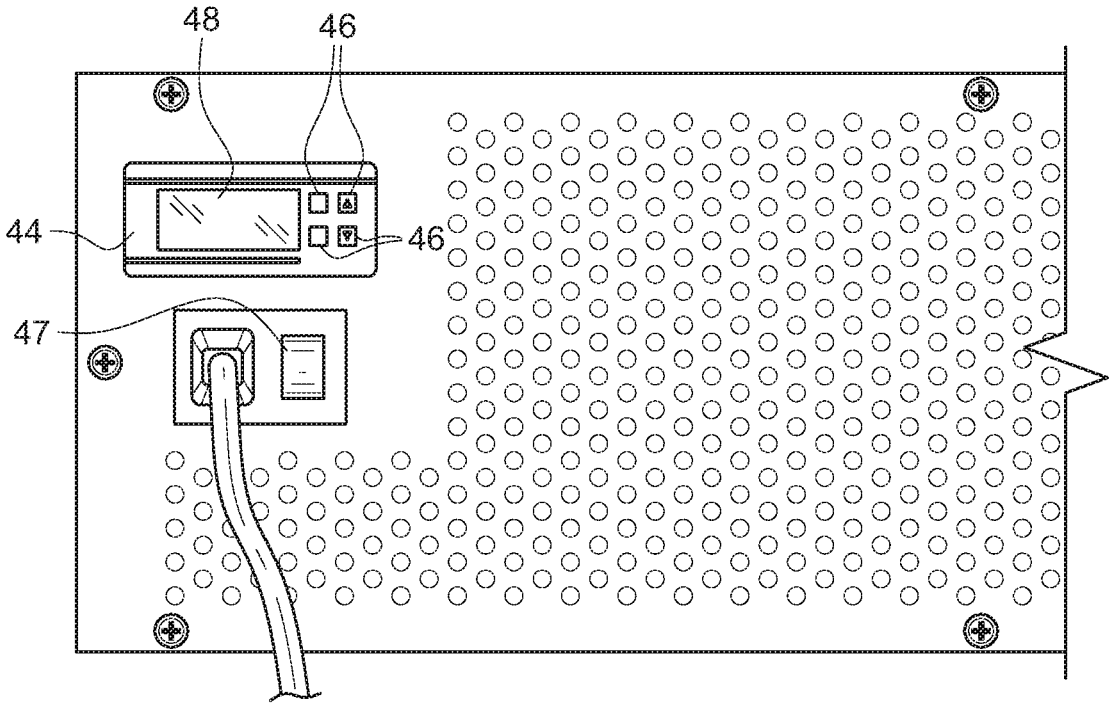
FIG. 8 is view of the control panel on the back side of the diaper pail freezer according to the embodiment of the present invention.

The refrigeration system can further include a controller that is couple to a control panel 44 as best shown in FIG. 8. The control panel typically includes one or more buttons 46 that permit a user to set and adjust the temperature of the interior compartment 14 as well as an off and on switch 47. An LED display 48 is also typically provided that displays the current temperature and setpoint temperature for the interior compartment.

The lid assembly 16 is best shown in FIGS. 1-6 and includes (i) a base portion 26, (ii) an outer lid 28, and an inner lid 30. The lid assembly further includes a removable securing frame 32 that is individually depicted in FIG. 6*a*&*b*.

The base portion 26 is fixedly coupled to the open end of the body 12 and forms left, right, front and back 34*a-d* side edges. The edges together form a square/rectangular opening that have upwardly facing top side surfaces as best shown in FIG. 5. The upwardly facing top side surfaces define an upwardly extending top side ridge 36 that extends around the perimeter of the open top side of the interior compartment 14. The upwardly facing top side surfaces also include a top side channel 38 that is outwardly adjacent to and circumscribing the the top side ridge. Additionally, the top side channel is circumscribed by a interface surface 40 against on which a downwardly facing rim 41 of the outer lid 28 rests when the lid is closed. Along the back side edge of the base portion, an outer hinge 42 is provided that interfaces with the outer lid pivotally connecting the lid to the base portion.

Figure 3A:
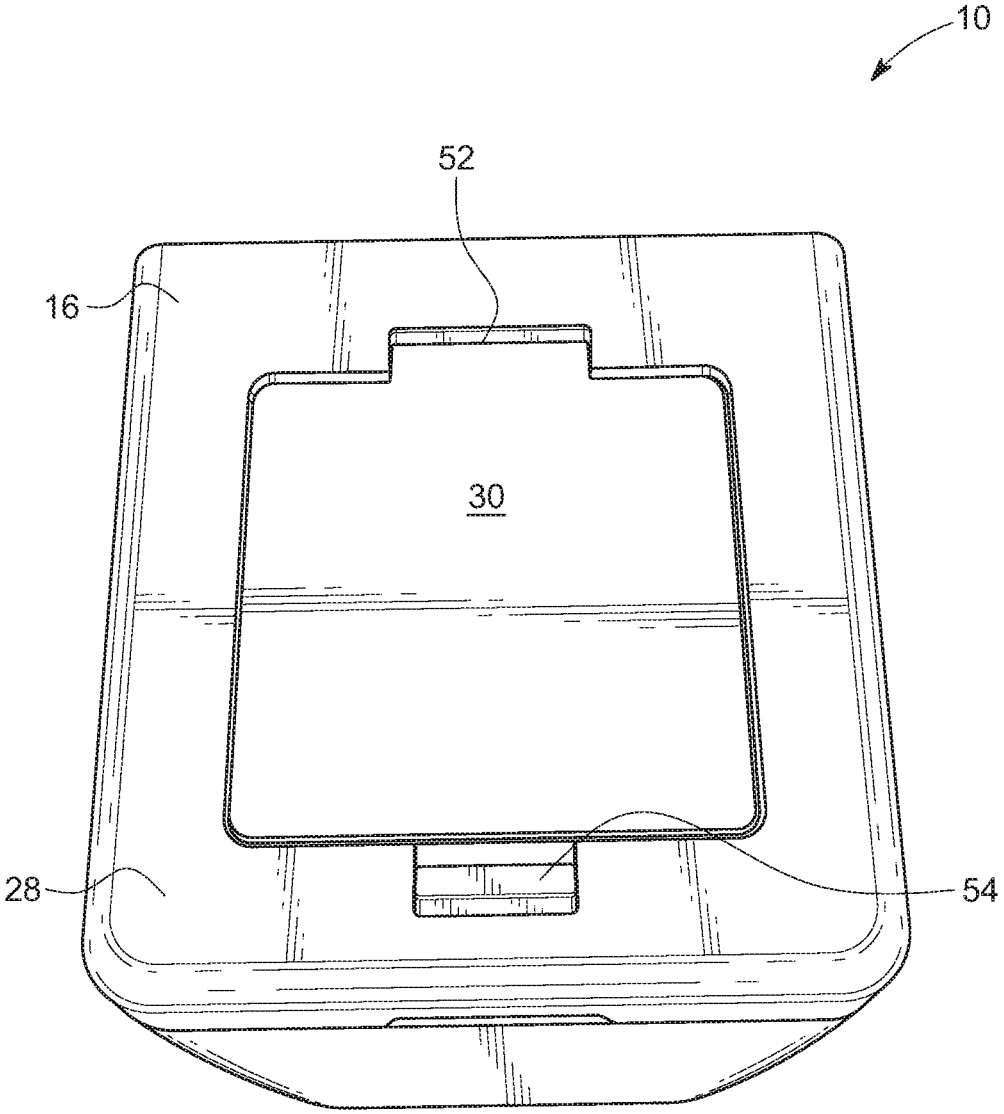
FIG. 3*a*&*b* are a top side perspective views of the diaper pail freezer with the inner lid closed and opened respectively according to the embodiment of the present invention.
Figure 3B:
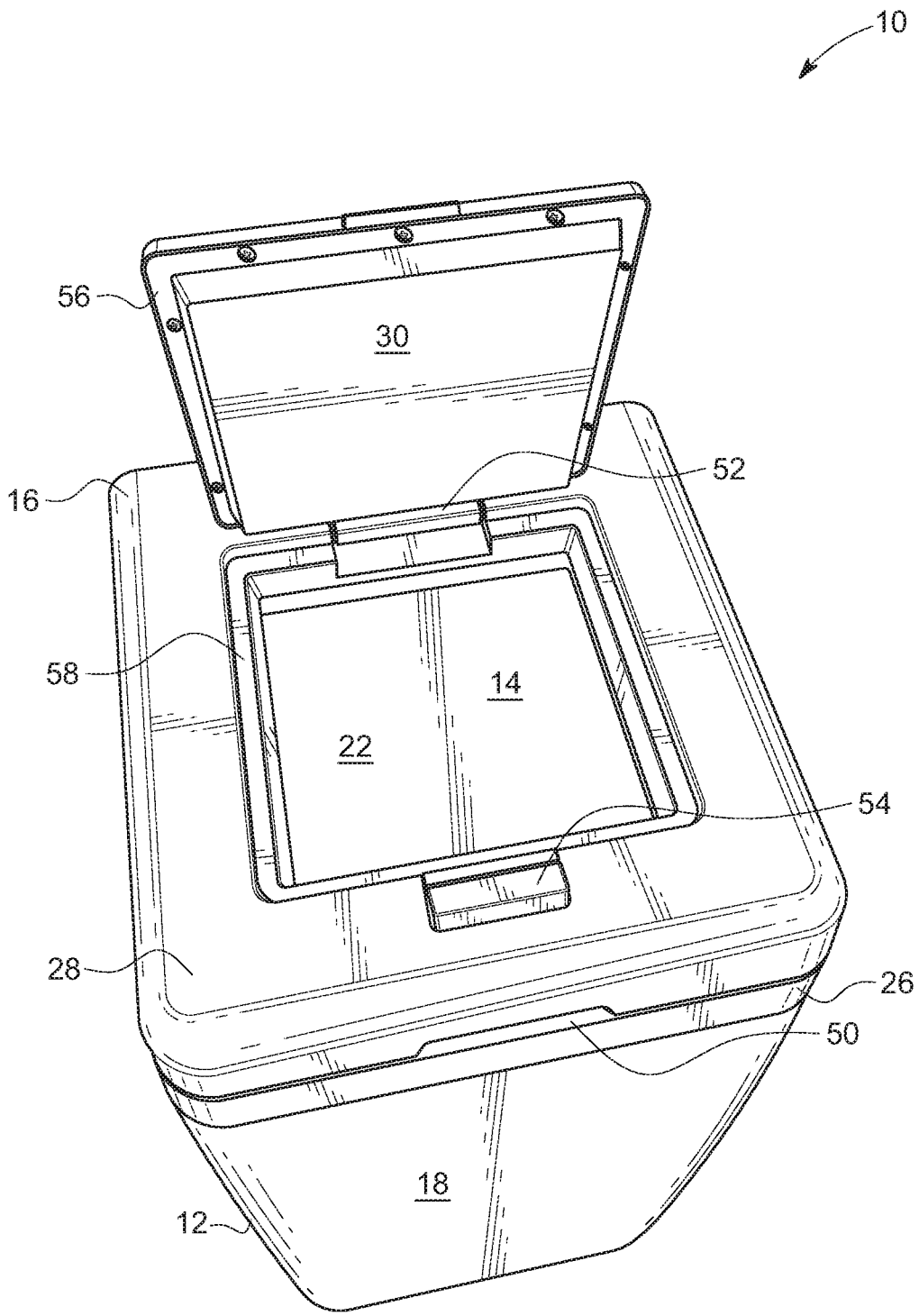

The outer and inner lids 28&30 are best shown in FIGS. 1-3. the outer lid completely covers the base portion 26 and the opening to the interior compartment 14. As mentioned, it is attached to the base portion by way of the outer hinge. In at least come variations, the outer hinge biases the outer lid into the closed position. However, when opened 90 degrees or more until encountering a stop provided in the outhinge, the outer lid will typically remain open until closed by a user, thereby facilitating the easy removal and replacement of a plastic bag. A recess 50 is provided along the underside of the outer lid along its front edge providing a user with a handle by which to open the lid.

The inner lid 30 is completely centered and contained within the outer lid. It is pivotally connected to the outer lid along a back edge thereof by way of an inner hinge 52. The inner hinge typically biases the inner lid open. To hold the lid in a closed position, a sprung latch 54 is provided along a front edge. To open the inner lid, a user need only push downwardly on the latch which releases the lid and causes it to spring open. The inner lid permits access to the interior compartment 14 conveniently without interfering with the top end (or opening) of the plastic bag. By biasing the lid in the open position the user only requires one hand to open the lid instead of two freeing the other hand to hold the soiled diaper or keep a hand on an infant being changed. A lid lip 56 is provided around the edge of the inner lid and a corresponding recessed lip 58 is provided in the inner lid opening on the outer lid. When the inner lid is closed, the lips provide at least a partial seal to hinder the escape of fumes from the interior compartment 14. In some variations, one or both lips can include an elastomeric or foam layer that compresses when the inner lid is closed providing enhanced sealing.

Figure 4:
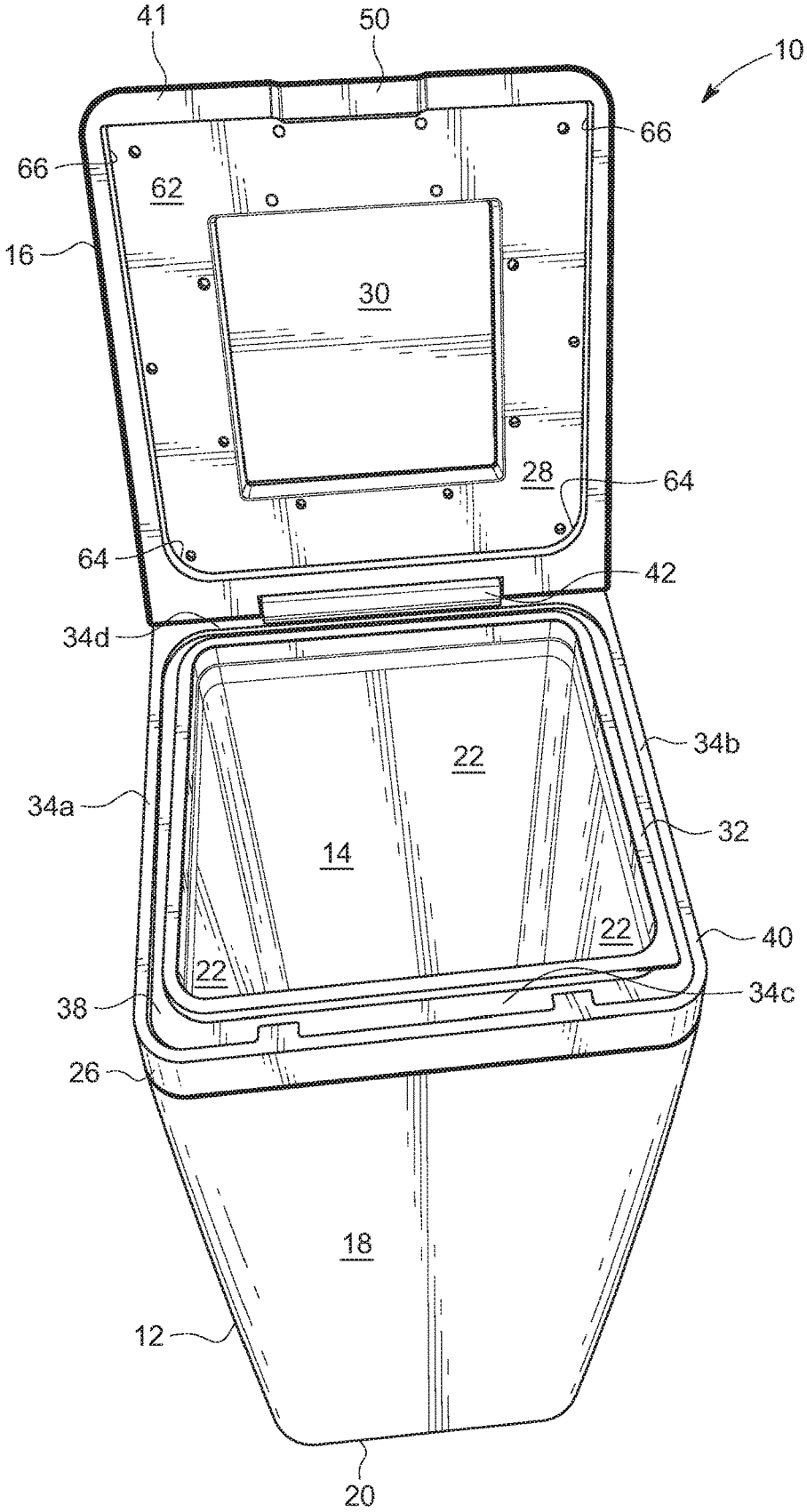
FIG. 4 is a top side perspective view of the diaper pail freezer with the outer lid open according to the embodiment of the present invention.
Figure 6A:
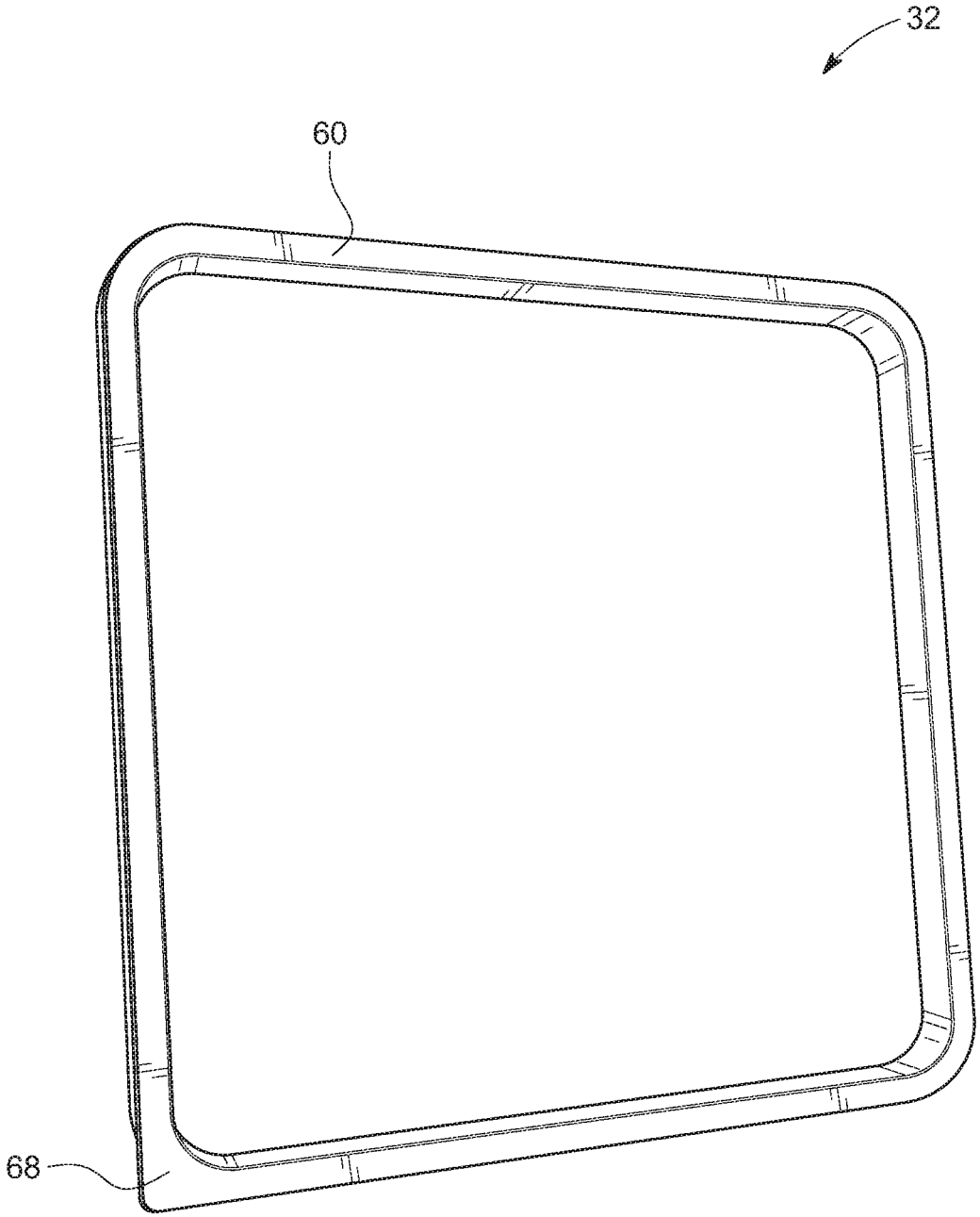
FIG. 6*a*&*b* are top and bottom perspective views of the securing frame configured for receipt over the circumscribing ridge according to the embodiment of the present invention.
Figure 6B:
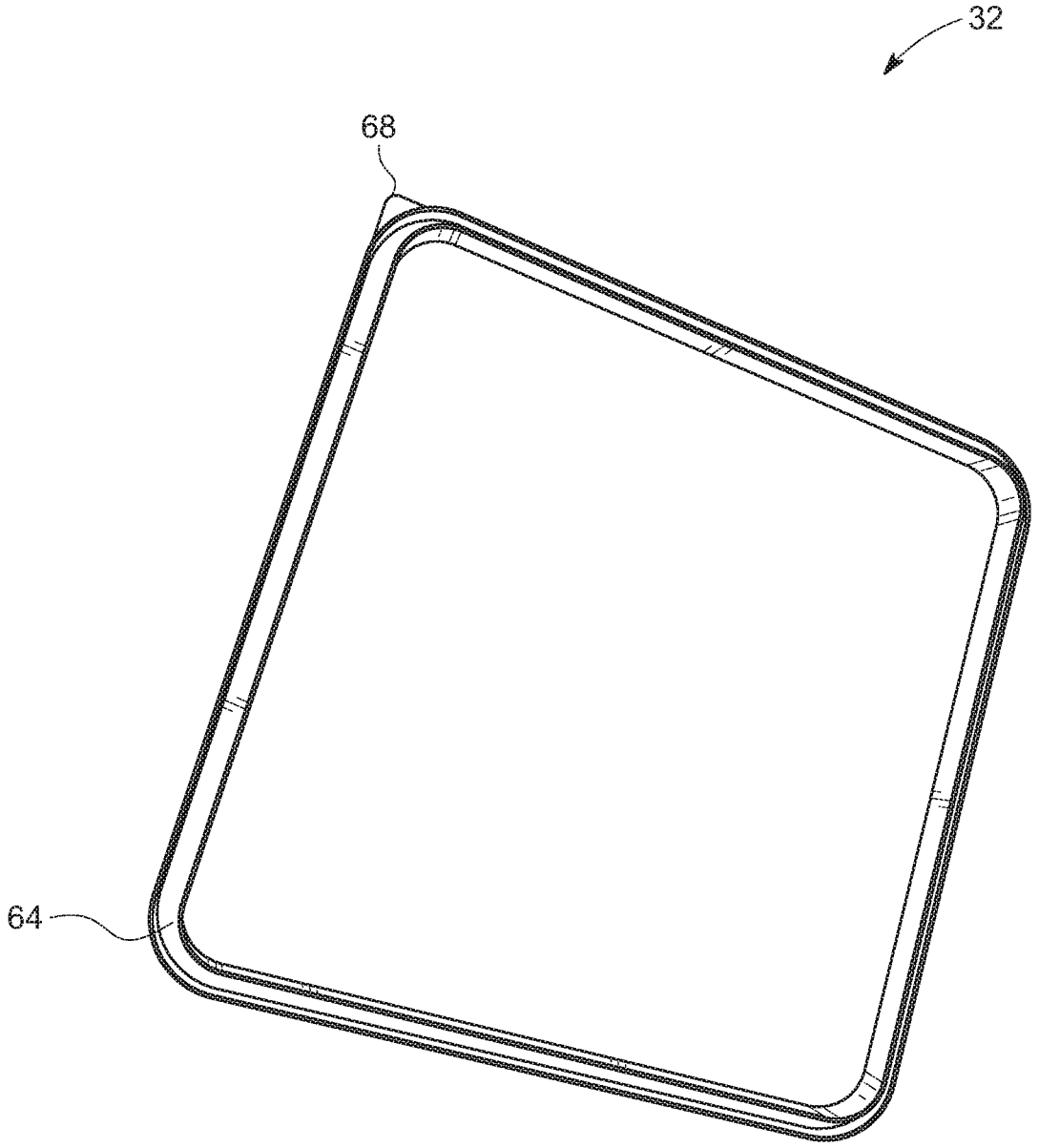
Figure 7:
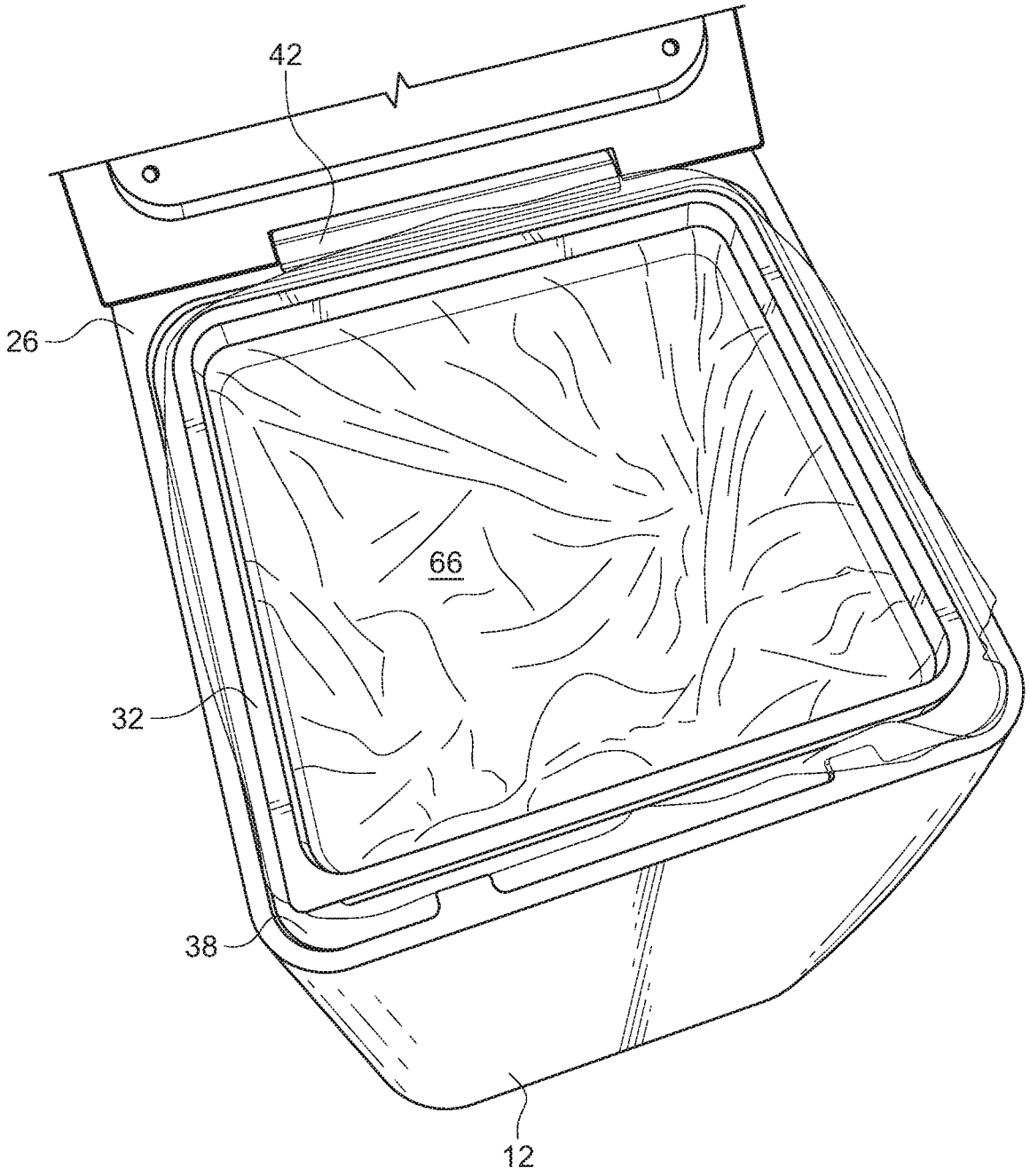
FIG. 7 is a perspective top view showing the securing frame received over the circumscribing ridge with a plastic trash bag received there between according to the embodiment of the present invention.

The aforementioned securing frame 32 is illustrated in FIG. 6*a*&*b* and shown received over the top side ridge 36 in FIGS. 4 & 7. The securing frame is characterized by a flat top surface 60 that is configured to fit flush against a downwardly facing flat securing surface 62 of the outer lid (see FIG. 4) when the frame is secured over the top side ridge. This interface forms a seal to hinder or prevent the escape of fumes from the interior compartment 14. In some variations, one or both opposing surfaces can include an elastomeric or foam layer that compresses when the outer lid is closed providing enhanced sealing.

The securing frame 32 is further characterized by a downwardly facing securing channel 64 as best seen in FIG. 6*a*. This channel is configured to be received over the top side ridge as shown in FIG. 4 and with a plastic bag 66 sandwiched between the ridge and the channel in FIG. 7. Also of note, one corner of the securing frame has an extended corner flange 68. This flange is shown in the front left corner of FIG. 7. The flange permits a user to more easily remove the frame, such as when he/she is changing the plastic bag. With reference to FIG. 4, the interface between the recessed securing surface 62 and the downwardly facing rim 41 on the outer lid is radiused where the edge intersections meet 64 near the back side of the outer lid but the front edge intersections come to a point 66 where they meet. This difference prevents the user from placing the securing frame over the top ridge with the corner flange being located in the back as the interaction of the radiused edge intersection 64 and the corner flange will prevent the out lid from fully closing; wherein, the front edge intersection points 66 do not provide any interference to closing the lid.

When a plastic bag 66 is received in the interior compartment 14 and secured in place proximate its open end by being sandwiched between the top side ridge 36 and the securing frame 32, the portion of the bag extending beyond the top side ridge including the open end can be received in the top side channel 38 to prevent it from extending out the sides of the diaper pail at the interface between the base portion 26 and the outer lid 28.

Methods of Using Embodiments of the Diaper Pail

Initially, the diaper pail 10 is plugged in and the refrigeration system is turned on. Normally, the system will be set to cool the interior compartment 14 to below freezing; however, a user may desire to adjust the temperature setpoint using the control panel 44.

To further prepare the unit for use a plastic garbage bag 66 is placed within the interior compartment. First, the outer lid 28 is opened, and the securing frame 32 removed from the top side ridge 36 assuming it was previously installed. Second, a bag is placed in the interior compartment with the open end extending slightly beyond and over the top side ridge. The securing frame is then installed over the top side ridge sandwiching the bag in place near its top end. The portion of the bag extending beyond the securing frame and top side ridge is positioned in the top side channel 38 and the outer lid is closed.

To dispose of a soiled diaper, a user presses the sprung latch 54 causing the inner lid 30 to pop open. The diaper is then dropped through the opening into the interior compartment 14. The inner lid is then closed substantially sealing the fumes odoriferous diaper within the compartment. As the diaper cools, its ability to generate fumes is reduced if not eliminated.

To empty the pail after it has become full, the user opens the outer lid 28, removes the securing frame 32 typically by pulling upwardly on it from the extended flange 68, and pulls the bag 66 from the interior compartment for disposal.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention. Embodiments of the present invention are described as a "diaper pail". While one of the intended uses of the embodiments is as a diaper pail, it is appreciated that a refrigerated container have the features described herein and in the claims below can be used for other purposes.

We claim:

1. A diaper pail comprising:

a container defining an interior compartment and having an open top surrounded by one or more top side edges; and a dual lid assembly, the lid assembly including (1) a outer lid pivotally connected to a top side edge of the one or more top side edges by an outer hinge and configured to cover the open top and to substantially cover the side edges, (ii) an inner lid wholly contained within and smaller than the outer lid, the inner lid being pivotally connected to the outer lid by an inner hinge and provide access to the interior compartment when opened;

wherein the one or more top side edges define an upwardly extending top side ridge circumscribing the open top, and wherein the diaper pail further comprises a securing frame with a downwardly facing securing channel, the securing channel being configured to be received over the top side ridge; and wherein the one or more top side edges further define a top side channel outwardly adjacent to and circumscribing the top side ridge.

2. The diaper pail of claim 1, further including a refrigeration mechanism, the configured to cool the interior compartment to at least a temperature less than 10 degrees Celsius.

3. The diaper pail of claim 2, wherein the refrigeration mechanism comprises a compressor.

4. The diaper pail of claim 2, wherein the refrigeration mechanism comprises a thermoelectric module.

5. The diaper pail of claim 2, including a control panel permitting the temperature setting of the interior compartment to be adjusted.

6. The diaper pail of claim 1, further including a refrigeration mechanism, the configured to cool the interior compartment to at least a temperature less than 0 degrees Celsius.

7. The diaper pail of claim 1, wherein the securing frame completely covers a top edge of the top side ridge.

8. The diaper pail of claim 7, wherein the securing frame has a flat top surface, the flat top surface interfaces with a downwardly facing flat securing surface on the outer lid to form a first seal.

9. The diaper pail freezer of 8, furthering including a sealing material located on one or both the flat top surface of the securing frame or the corresponding downwardly facing flat securing surface of the outer lid.

10. The diaper pail freezer of 8, wherein the inner lid forms a second seal with the upper lid when closed.

11. The diaper pail of claim 1, wherein the outer hinge biases the outer lid closed.

12. The diaper pail of claim 1, wherein the inner hinge biases the inner lid open.

13. The diaper pail of claim 12, wherein the inner lid portion includes a latching mechanism.

14. The diaper pail of claim 1 in combination with a plastic bag, the plastic bag having a bag open end, wherein the bag is received over the top side ridge and sandwiched between the top side ridge and the securing frame proximate the bag open end, and wherein the bag open end extending beyond the top side ridge is substantially contained in the top side channel when the outer lid is closed.

15. A method of using the diaper pail of claim 1, the method comprising:

placing a plastic bag having a bag open end in the interior compartment with the bag extending over the top side ridge proximate the bag open end;

placing the downwardly facing securing channel of the securing frame over the top side ridge sandwiching the plastic bag proximate the bag open end therein;

positioning the bag open end in the top side channel and then closing the outer lid;

cooling the interior compartment to a temperature below ambient temperature opening the inner lid and placing a soiled diaper into the interior compartment through an associated opening; and closing the inner lid.

16. A diaper pail in combination with a plastic bag:

the diaper pail comprising (1) a container defining an interior compartment and having an open top surrounded by one or more top side edges, (2) a refrigeration mechanism configured, the configured to cool the interior compartment to at least a temperature less than 10 degrees Celsius, and (3) a dual lid assembly, the lid assembly including (i) an outer lid pivotally connected to a top side edge of the one or more top side edges by an outer hinge and configured to cover the open top and to substantially cover the side edges, and (ii) an inner lid wholly contained within and smaller than the outer lid, the inner lid being pivotally connected to the outer lid by an inner hinge and provide access to the interior compartment when opened, wherein the one or more top side edges define an upwardly extending top side ridge circumscribing the open top, and wherein the diaper pail further comprises a securing frame with a downwardly facing securing channel, the securing channel being configured to be received over the top side ridge; and wherein the plastic bag has a bag open end, the bag being received over the top side ridge and sandwiched between the top side ridge and the securing frame proximate the bag top end.

17. The combination of claim 16, wherein the refrigeration mechanism comprises a compressor.

18. The combination of claim 16, wherein the refrigeration mechanism comprises a thermoelectric module.

19. The combination of claim 16, wherein the diaper pail further includes a control panel permitting the temperature setting of the interior compartment to be adjusted.

* * * * *